US006435498B1

(12) United States Patent
Stefan et al.

(10) Patent No.: US 6,435,498 B1
(45) Date of Patent: Aug. 20, 2002

(54) ALIGNER MECHANISM FOR A MAIL HANDLING SYSTEM

(75) Inventors: Christopher Julius Stefan, Derby; Eric A. Belec, Southbury; John J. Mercede, Jr., Easton; James A. Salomon, Cheshire; Steven A. Supron, Middlebury; Shae Lynn Wilson, Hamden; Leo Wologodzew, Shelton; Anthony E. Yap, Danbury, all of CT (US)

(73) Assignee: PItney Bowes, Inc., Stamford, CT (US)

( * ) Notice: Subject to any disclaimer, the term of this patent is extended or adjusted under 35 U.S.C. 154(b) by 0 days.

(21) Appl. No.: 09/964,791

(22) Filed: Sep. 26, 2001

Related U.S. Application Data

(62) Division of application No. 09/411,064, filed on Oct. 4, 1999.

(51) Int. Cl.[7] ..... B65H 29/68

(52) U.S. Cl. ..... 271/2; 271/3.12; 271/31.1; 271/182; 271/403; 271/10.03; 271/265.02; 271/129; 271/258.01

(58) Field of Search ..... 271/2, 12, 31.1, 271/182, 403, 10.03, 265.02, 3.12, 149, 183, 270, 111, 10.1, 10.7, 4.03, 4.06, 4.09, 256, 258.01, 129

(56) References Cited

U.S. PATENT DOCUMENTS

| | | | | |
|---|---|---|---|---|
| 3,817,516 A | | 6/1974 | Lazzarotti et al. | 271/150 |
| 3,901,797 A | | 8/1975 | Storace et al. | 209/121 |
| 4,615,519 A | | 10/1986 | Holodnak | 271/122 |
| 4,744,554 A | | 5/1988 | Kulpa et al. | 271/251 |
| 4,775,143 A | | 10/1988 | Arnoldi et al. | 271/251 |
| 5,052,875 A | * | 10/1991 | Miller et al. | 414/403 |
| 5,238,236 A | | 8/1993 | Belec et al. | 271/34 |
| 5,518,122 A | | 5/1996 | Tilles et al. | 209/539 |
| 5,560,595 A | * | 10/1996 | Kulpa | 271/2 |
| 5,560,598 A | | 10/1996 | Goldkuhle | 271/263 |
| 5,697,610 A | | 12/1997 | Holmes et al. | 271/263 |
| 6,328,300 B1 | * | 12/2001 | Stefan et al. | 271/2 |

* cited by examiner

*Primary Examiner*—Christopher P. Ellis
*Assistant Examiner*—Mark A. Deuble
(74) *Attorney, Agent, or Firm*—Alberta A. Vitale; Charles R. Malandra, Jr.; Angelo N. Chaclas

(57) ABSTRACT

The present invention provides an aligner apparatus which bottom edge aligns documents and separates documents and provides adequate gap between documents for subsequent processing. The an aligner apparatus includes first and second guide walls, forming an alley along the document feed path in which the documents are relieved of interdocument forces allowing bottom edge alignment of the documents with the document feed path. A trap assembly including first and second trap levers is lever mounted along the document feed path on a side of the guide wall and when actuated, cause opposing forces on one-another in order to grab the documents as they move along the feed path in the aligner apparatus so as to control the gap between the documents. It apparatus further provides an adequate gap between documents while reducing noise. Each trap lever has a head portion which is fitted with a resilient pad which is attached to the trap arm in a manner that forms a gap between the head and the pad. The resilient pad and the gap operate to reduce noise created by the trap arm when actuated.

3 Claims, 9 Drawing Sheets

ALIGNER MECHANISM FOR A MAIL HANDLING SYSTEM

This application is a division of application Ser. No. 09/411,064, filed Oct. 4, 1999.

BACKGROUND

The processing and handling of mailpieces and other documents consumes an enormous amount of human and financial resources, particularly if the processing of the mailpieces is done manually. The processing and handling of mailpieces not only takes place at the Postal Service, but also occurs at each and every business or other site where communication via the mail delivery system is utilized. That is, various pieces of mail generated by a plurality of departments and individuals within a company need to be collected, sorted, addressed, and franked as part of the outgoing mail process. Additionally, incoming mail needs to be collected and sorted efficiently to ensure that it gets to the addressee in a minimal amount of time. Since much of the documentation and information being conveyed through the mail system is critical in nature relative to the success of a business, it is imperative that the processing and handling of both the incoming and outgoing mailpieces be done efficiently and reliably so as not to negatively impact the functioning of the business.

In view of the above, various automated mail handling machines have been developed for processing mail (removing individual pieces of mail from a stack and performing subsequent actions on each individual piece of mail). However, in order for these automatic mail handling machines to be effective, they must process and handle "mixed mail." The term "mixed mail" is used herein to mean sets of intermixed mailpieces of varying size (postcards to 9" by 12" flats), thickness, and weight. In addition, the term "mixed mail" also includes stepped mail (i.e. an envelope containing therein an insert which is smaller than the envelope to create a step in the envelope), tabbed and untabbed mail products, and mailpieces made from different substrates. Thus, the range of types and sizes of mailpieces which must be processed is extremely broad and often requires trade-offs to be made in the design of mixed mail feeding devices in order to permit effective and reliable processing of a wide variety of mixed mailpieces.

In known mixed mail handling machines which separate and transport individual pieces of mail away from a stack of mixed mail, the stack of "mixed mail" is first loaded onto some type of conveying system for subsequent sorting into individual pieces. The stack of mixed mail is moved as a stack by an external force to, for example, a shingling device. The shingling device applies a force to the lead mailpiece in the stack to initiate the separation of the lead mailpiece from the rest of the stack by shingling it slightly relative to the stack. The shingled mailpieces are then transported downstream to, for example, a separating or singulating device which completes the separation of the lead mailpiece from the stack so that individual pieces of mail are transported further downstream for subsequent processing. In the mailing machine described immediately above, the various forces acting on the mailpieces in moving the stack, shingling the mailpieces, separating the mailpieces and moving the individual mailpieces downstream often act in a counterproductive manner relative to each other. For example, inter-document stack forces exist between each of the mailpieces that are in contact with each other in the stack. The inter-document stack forces are created by the stack advance mechanism, the frictional forces between the documents, and potentially electrostatic forces that may exist between the documents. The inter-document forces tend to oppose the force required to shear the lead mailpiece from the stack. Additionally, the interaction of the force used to drive the shingled stack toward the separator and the separator forces can potentially cause a thin mailpiece to be damaged as it enters the separator. Furthermore, in a conventional separator, there are retard belts and feeder belts that are used to separate the mailpiece from the shingled stack. Both the forces applied by the retard belts and the feeder belts must be sufficient to overcome the inter-document forces previously discussed. However, the friction force generated by the retard belts cannot be greater than that of the feeder belts or the mailpieces will not be effectively separated and fed downstream to another mail processing device. Moreover, if the feeding force being applied to the mailpieces for presenting them to the separator is too great, another potential problem which may occur is that a plurality of mailpieces (multi-feeds) will be forced through the separator without the successful separation of the mailpieces. Another problem that can occur is that the interdocument stack forces can keep the mailpieces from deskewing or bottom edge aligning which would prevent the mailpieces from separating or could also cause an over-height problem in the mail handling machine.

Another problem that can occur in the handling of the mailpieces is that the desired gap between each mailpiece may not be achieved by the document separators. The gap is important because it is necessary for timing of down stream processing such as OCR (optical character recognition). Gap also effects throughput of the mail handling machine; if the gap is too large, the throughput of the machine decreases. A buffer between document singulating apparatus may be used to assist with providing the proper gap between mailpieces and keep the mailpieces from colliding which can damage the mailpieces. When a mail handling machine has two document singulating apparatus, the down stream document singulating apparatus will function to delay processing of a mailpiece in a multipiece feed situation such that a next mailpiece can crash into the mailpiece in the downstream stream document singulating apparatus. A stopping apparatus can be used to stop the next mailpiece, this improves the gap between the mailpieces and subsequently keeps the mailpieces from colliding.

In view of the above, it is recognized that large forces are desirable to act on the mailpieces to accelerate and separate the mailpieces in a reliable and high throughput manner. However, these same high forces can damage the mailpieces being processed (i.e. buckle lightweight mailpieces) and keep the mailpieces from being bottom edge aligned. Conversely, if the forces used to accelerate and separate the mailpieces are too small, then poor separation, lower throughput, and stalling of the mailpieces being processed will result. Put in another way, thin mailpieces are weak and require low forces to prevent them from being damaged, while thick/heavy mail is strong and requires high forces for proper separation and feeding. The effect is that when the thick/heavy mail is in the stack higher stack normal forces are created thereby increasing inter-document forces and requiring higher nip forces at the separator. Thus, the structure used to separate a stack of mixed mail must take into account the counterproductive nature of the forces acting on the mailpieces and be such that an effective force profile acts on the mailpieces throughout their processing cycle so that effective and reliable mailpiece separation and transport at very high processing speeds (such as four mailpieces per second) can be accomplished without physical damage occurring to the mailpieces. However, since the desired force profile acting on a particular mailpiece is dependent upon the size, thickness, configuration, weight, and substrate of the individual mailpiece being processed, the design of a mixed mail feeder which can efficiently and reliably process a wide range of different types of mixed mailpieces has been extremely difficult to achieve. The mail handling machine needs a portion which has reduced interdocument forces which allows the mailpiece to bottom edge align with the assistance of gravity.

Furthermore, in achieving the mechanical separation of mail, the mail handling machine produces mechanical noise. The reduction of this noise can be difficult to balance with the mechanical design needs of the machine. Much noise can be produced by the various mechanisms of mail handling machine including the separation mechanisms and gap control mechanisms. The noise can impact the functioning of a mail room environment where the mail handling machine is being operated. Over a period of time, noise can induce hearing loss, and cause annoyance and irritation of workers. Therefore, it is favorable to achieve lower operating sound pressure levels in the mail handling machine by using materials and techniques that cure noise problems.

SUMMARY OF THE INVENTION

It is an object of the invention to provide an aligner apparatus which bottom edge aligns documents and separates documents and provides adequate gap between documents for subsequent processing.

The above object is met by providing an aligner apparatus which includes first and second guide walls, each guide wall positioned parallel to the document feed path and facing the other guide wall forming an alley along the document feed path in which the documents are relieved of interdocument forces allowing bottom edge alignment of the documents with the document feed path, the guide walls forming a plurality of openings, each opening in the first guide wall being in alignment with an opening in the second guide wall; and a trap assembly comprising first and second trap levers, each trap lever mounted along the document feed path on a side of the guide wall opposite the document feed path, each trap lever received by one of the plurality of openings in the guide walls and each trap lever opposing the other trap lever and positioned to, when actuated, cause opposing forces on one-another in order to grab the documents as they move along the feed path in the aligner apparatus so as to control the gap between the documents.

It is yet a further objective to provide an aligner apparatus which can provide adequate gap between documents while reducing noise. This object is met by providing a trap subassembly wherein the trap subassembly comprises trap levers for capturing the documents as they travel along the document feedpath. Each trap lever has a head portion which is fitted with a resilient pad which is attached to the trap arm in a manner that forms a gap between the head and the pad. The resilient pad and the gap operate to reduce noise created by the trap arm when actuated.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
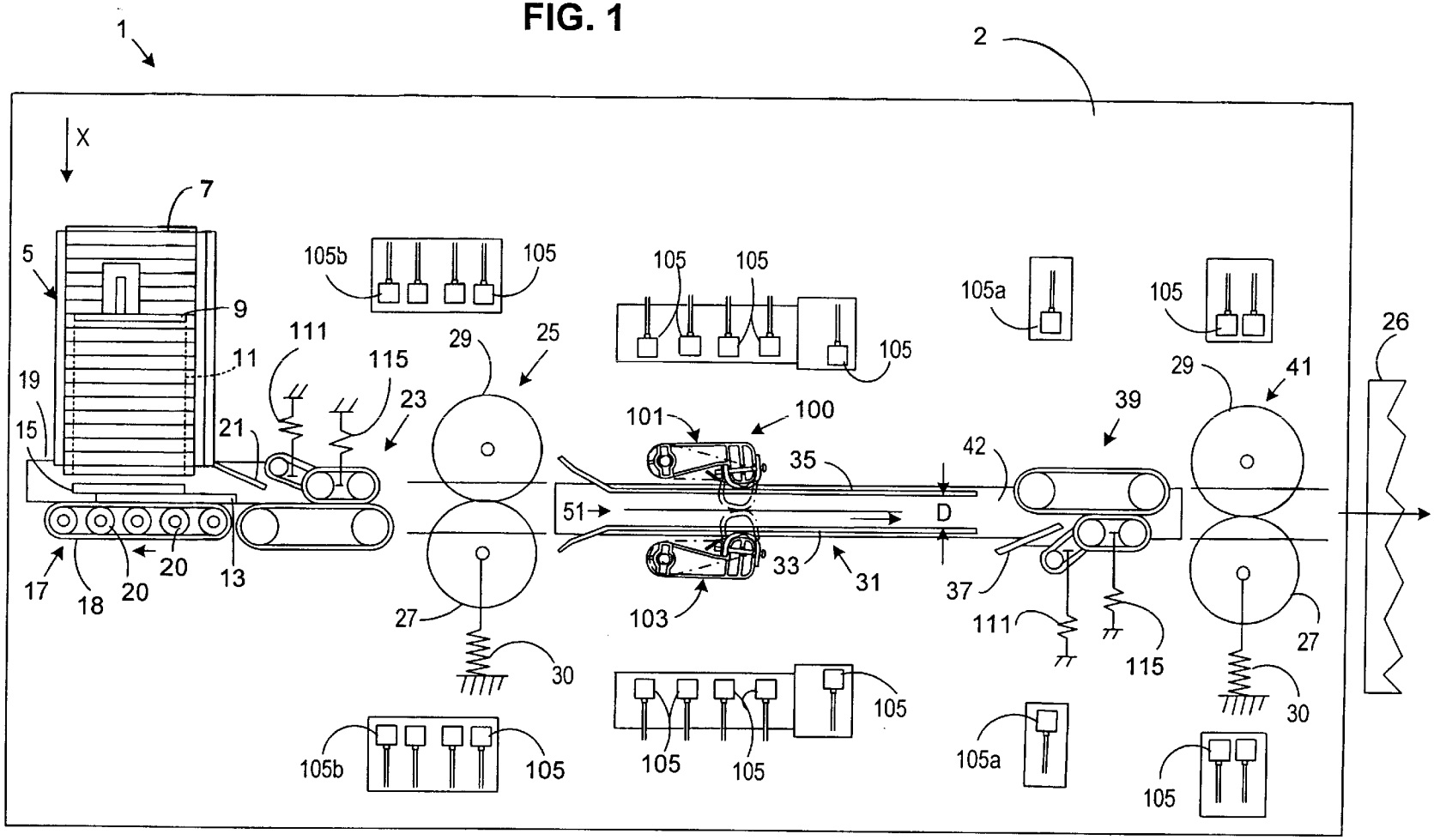
FIG. 1 is a schematic top plan view of a mixed mail feeder incorporating the inventive aligner mechanism.
Figure 2:
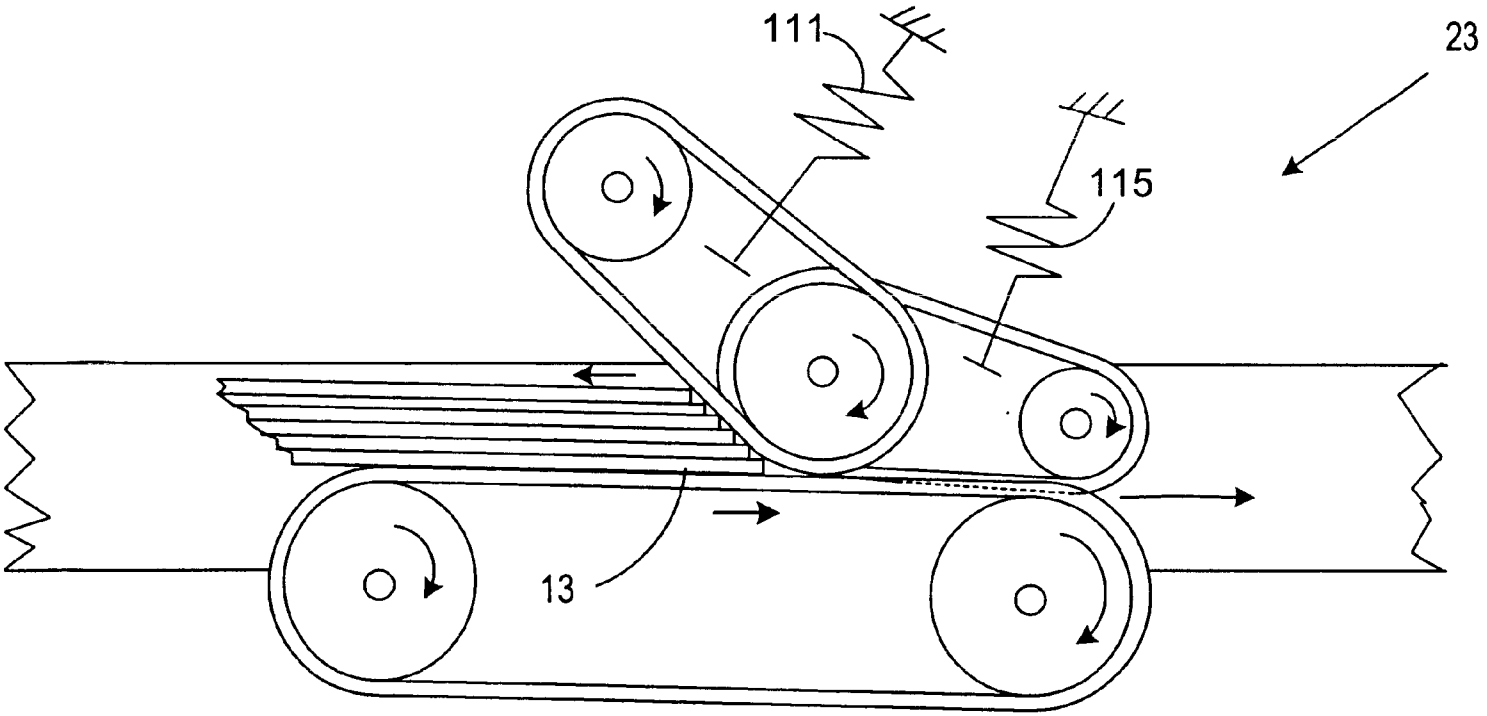
FIG. 2 is an enlarged and detailed top plan view of a singulator of FIG 1.

FIG. 1 shows a mixed mail feeder 1 having conventional framework 2 upon which all of the components of the mixed mail feeder 1 are mounted. Mixed mail feeder 1 includes a stack advance mechanism 5 having a continuous conveyor belt 7 mounted for rotation in a conventional manner about a plurality of pulleys (not shown) in the direction of arrow "X". Mounted on the conveyor belt 7 in a conventional manner is an upstanding panel 9 which moves with the conveyor 7 in the direction of arrow "X". In operation, a stack of mixed mail 11 is placed on the conveyor belt 7 and rests against the panel 9. The stack of mixed mail includes a lead mailpiece 13 and a second mailpiece 15. Thus, as the conveyor belt 7 is set into movement, the stack of mixed mail 11 is moved toward an input feed structure 17. Input feed structure 17 includes a belt 18 which is driven into rotation about a series of pulleys 20, at least one of which is a driven pulley. Accordingly, as the stack advance mechanism 5 forces the lead mailpiece 13 into contact with the belt 18, the lead mailpiece 13 is laterally moved away from stack of mixed mail 11. Additionally, a driven belt 19 which makes contact with the bottom edge of the lead mailpiece 13 also assists in moving the lead mailpiece 13 downstream past a guide mechanism 21 and toward a first document singulating apparatus 23. As shown, the combination of the stack advance mechanism 5, the input feed structure 17, and the guide plate 21 help to present the mailpieces which are removed from the stack of mixed mail 11 into the first document singulating apparatus 23 in a shingled manner as is more clearly shown in FIG. 2. The first document singulating apparatus 23 operates to separate the lead mailpiece 13 from the remaining stack of mixed mail 11 so that only individual mailpieces are presented to output feeding structure 25 for ultimate processing downstream to a processing station 26 where each individual mailpiece has some type of operation (metering, scanning, etc.) performed thereon.

Figure 3A:
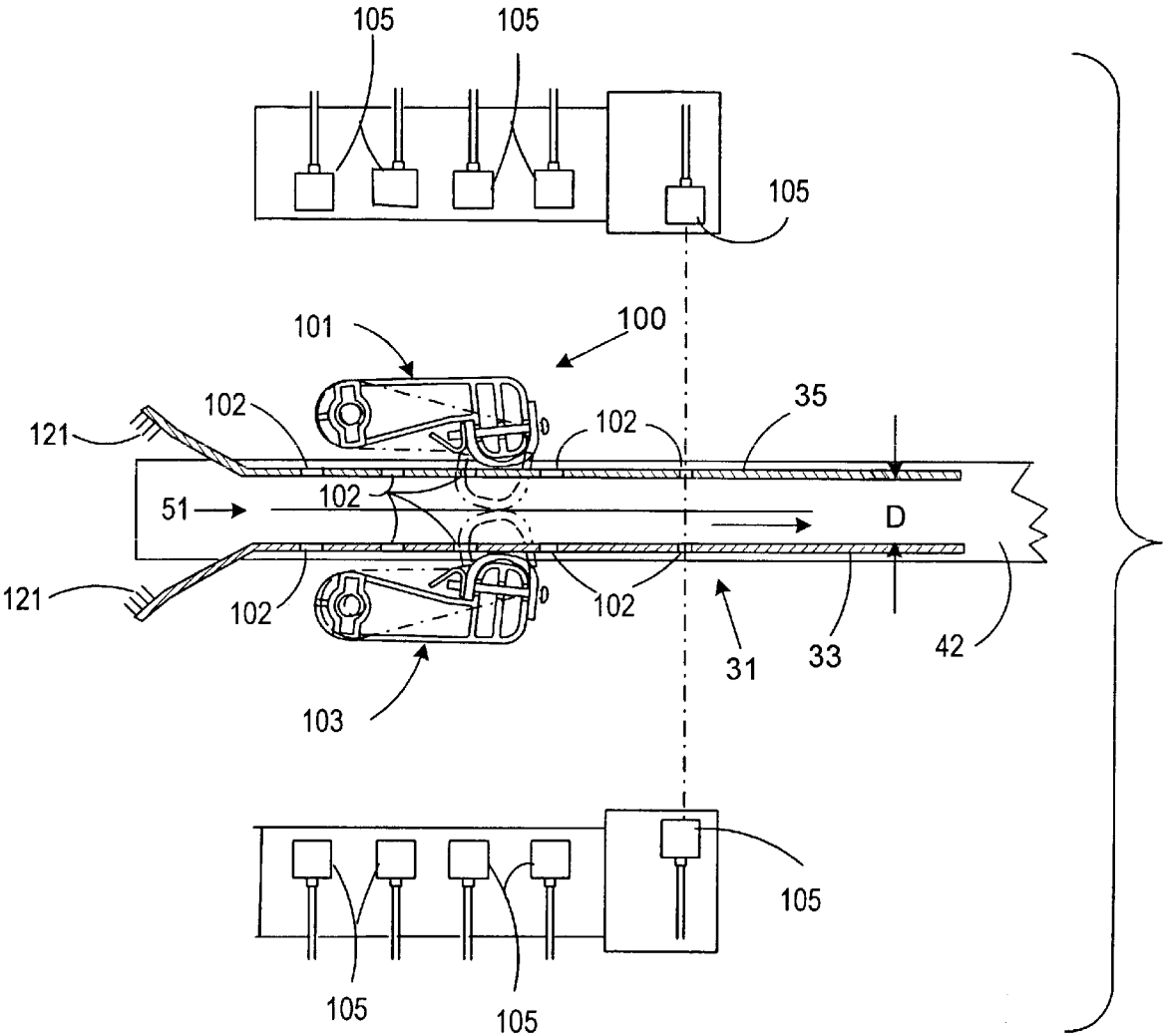
FIG. 3*a* is an enlarged and detailed top plan view of an aligner mechanism of FIG. 1.

Output feeding structure 25 includes a take away rollers 27 and 29 which receive the mailpiece as it exits the first document singulating apparatus 23 and helps to transport it downstream. The take away rollers comprise a drive roller 29 and an idler roller 27. The take away idler roller 27 is spring loaded by spring 30 and is moveable toward and away from the take away drive roller 29 to accommodate different mailpiece thicknesses. FIG. 3*a* is an enlarged and detailed top plan view of a aligner mechanism of FIG. 1 and illustrates a aligner station 31 consisting of two guide walls 33, 35 which help to direct the individual mailpieces in a vertical fashion to ensure that they are aligned on their bottom edge prior to transport past a second guide plate 37 and into a second document singulating apparatus 39. Subsequent to passage through the second document singulating apparatus 39, the individual mailpieces are transported into a second set of take away rollers 41 which transport the individual mailpieces to the processing station 26. The second set of takeaway rollers 41 has the same structural components as the first set of take away rollers 25.

The second singulating apparatus 39 has the same structural components as the first singulating apparatus 23 and can be driven by an independent drive system similar to that used for first singulating apparatus 23. The use of the redundant singulating apparatus structure improves the reliability of separating individual documents from each other since, if a multi-feed does pass through the first singulating apparatus 23 it is likely that the second singulating apparatus 39 will effectively separate the documents of a multi-feed.

In the aligner station 31, the mailpieces are driven along their bottom edges by a transport belt 42. The gap D between the guide walls 33, 35 allows that the frictional forces between the mailpieces are almost nonexistent. Since the frictional forces tend to cause mutli-mailpiece feeds, this configuration helps to prevent multi-mailpiece feeds from occurring at the second singulating apparatus 39. Furthermore, the aligner station acts as a buffer between first and second document singulating apparatus, allowing mailpieces to deskew or register onto the transport belt 42. Subsequent to passage through the second document singulating apparatus 39, the individual mailpieces are transported into the second set of take away rollers 41 which act on the mailpieces to transport the mailpieces to the processing station 26.

In the preferred embodiment, the guide walls 33, 35 are separated from each other on each side of the mailpiece feed path 51 by a distance of approximately 28 millimeters. This allows for the passage of ¾" thick mailpieces. However, other mailpiece thickness specifications and distances may be used. The minimum distance may be determined by the specification of the maximum width of mailpieces to be passed along the document feed path. Additionally, the distance is determined by the minimum angle that the smallest mailpiece would have with respect to the transport belt 42 when leaning against guide walls 33, 35. The angle, if too small, would cause the mailpiece to lean below the mailpiece sensors 105. This spacing would also allow most multi-feeds which leave first document singulating apparatus 23 to be transported through aligner station 31 without any large inter-document forces existing between the mailpieces because no significant normal feed force is present when the mailpieces are fed by belt 42. It should be noted that in an alternate embodiment only one document singulating apparatus upstream from the aligner station 31 may be used in the mixed mail feeder 1.

Additionally, antistatic brushes 121 (shown in FIG. 3*a*) may be mounted onto the guide walls to help prevent lightweight, static prone mailpieces such as mailpieces wrapped in wrapping sold under the trademark TYVEK® (manufactured by Dupont), envelopes and postcards from clinging to the walls. The leading edges of the guide walls 33, 35 are flared outward to minimize catch points. To provide jam clearance, one guide wall may be hinged to open at, for example, 45 degrees with positive stops at full close and full open. The minimum length of the aligner station 31 is governed by the maximum size of the mailpieces to be handled by the mixed mail system. That maximum length of the mailpieces is 14 inches and, therefore the aligner station 31 must be at least 14 inches in order to provide a distance sufficient enough to provide deskewing, between the two document singulating apparatus 23, 39. Furthermore, the length must be additionally increased to allow the mailpieces traveling through the aligner station 31 time to deskew or bottom edge align with the transport belt 42.

The aligner station 31 may include a trap subsystem 100 which provides gap enforcement between mailpieces. The gap is important because the mail handling machine may need time for processing that happens down stream in the processing station 26, such as OCR processing. Additionally, proper gap affects throughput of the mail handling machine. Gap is also helpful in a situation where there is a multifeed going into the second document singulating apparatus 39, as described below. The trap 100 allows the transport belt 42 to remain in constant motion while an interpiece gap is being maintained or lengthened instead of attempting to achieve the gap by stopping and starting the transport belt 42 which would stop all the mailpieces on the belt instead of just the mailpieces between which a larger gap is desired.

Figure 3B:
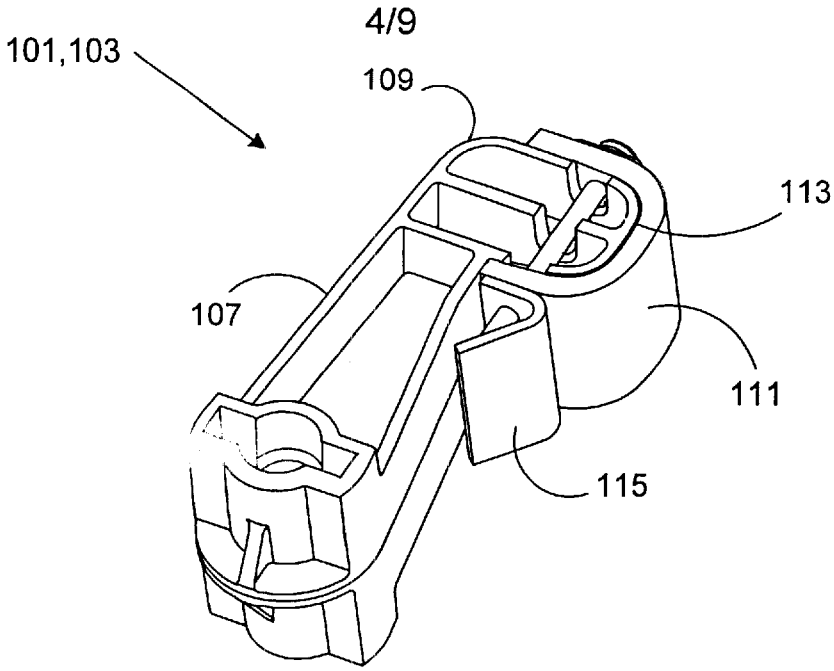
FIG. 3*b* is an enlarged and detailed perspective view of a trap lever.
Figure 3C:
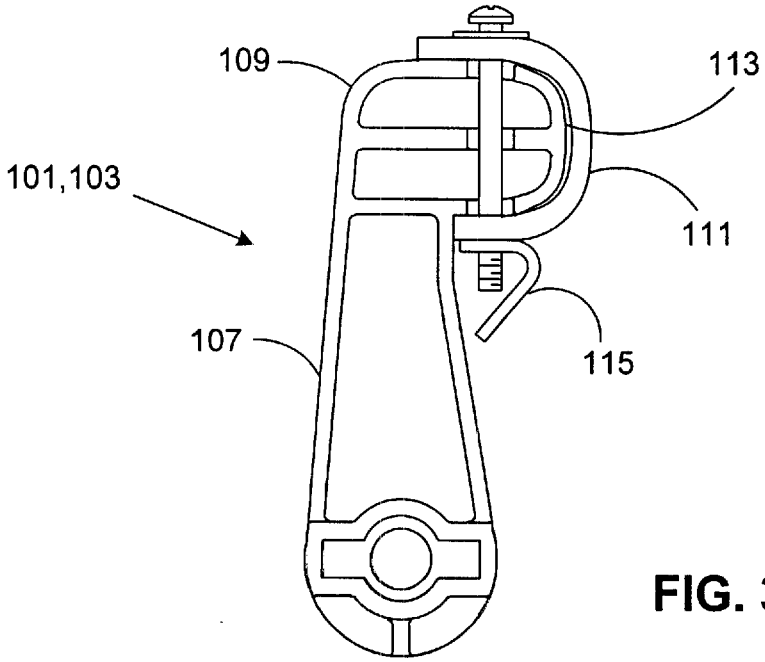
FIG. 3*c* is an enlarged and detailed top plan view of the trap lever.

The trap subsystem 100, illustrated in FIG. 3*a*, comprises two trap levers 101, 103 which are actuated in order to grab a mailpiece as it moves through the aligner station 31. The actuation is based upon timing information from feed path sensors 105 which are mounted along the feed path. Each sensor 105 may be, for example, a photo electric sensor for detection of light, which when blocked indicates that a mailpiece is on the transport belt in the area of the sensor 105, and when not blocked, indicates that there is no mailpiece in the area of the sensor. The sensor configurations for the various embodiments are example configurations, other configurations may be used as may be determined by one of ordinary skill in the art. The guide walls 33, 35 may have openings 102 which accommodate the sensors. The timing for actuating the trap levers may be determined by one of ordinary skill in the art; however, in the preferred embodiment, the trap levers 101, 103 may actuate any time too small a gap exists between mailpieces and that gap can not be widened by some other upstream mechanism in the mail handling machine such as the take away rollers 27, 29 of the output feed structure 25. In the event that the trap subassembly 100 is unable to stop the mailpiece in time, the second document singulating apparatus 39 would act to help enforce the gap control. Each trap lever 101, 103, illustrated in FIGS. 3*a*, 3*b* and 3*c*, comprises an arm portion 107 and a head portion 109.

Figure 4:
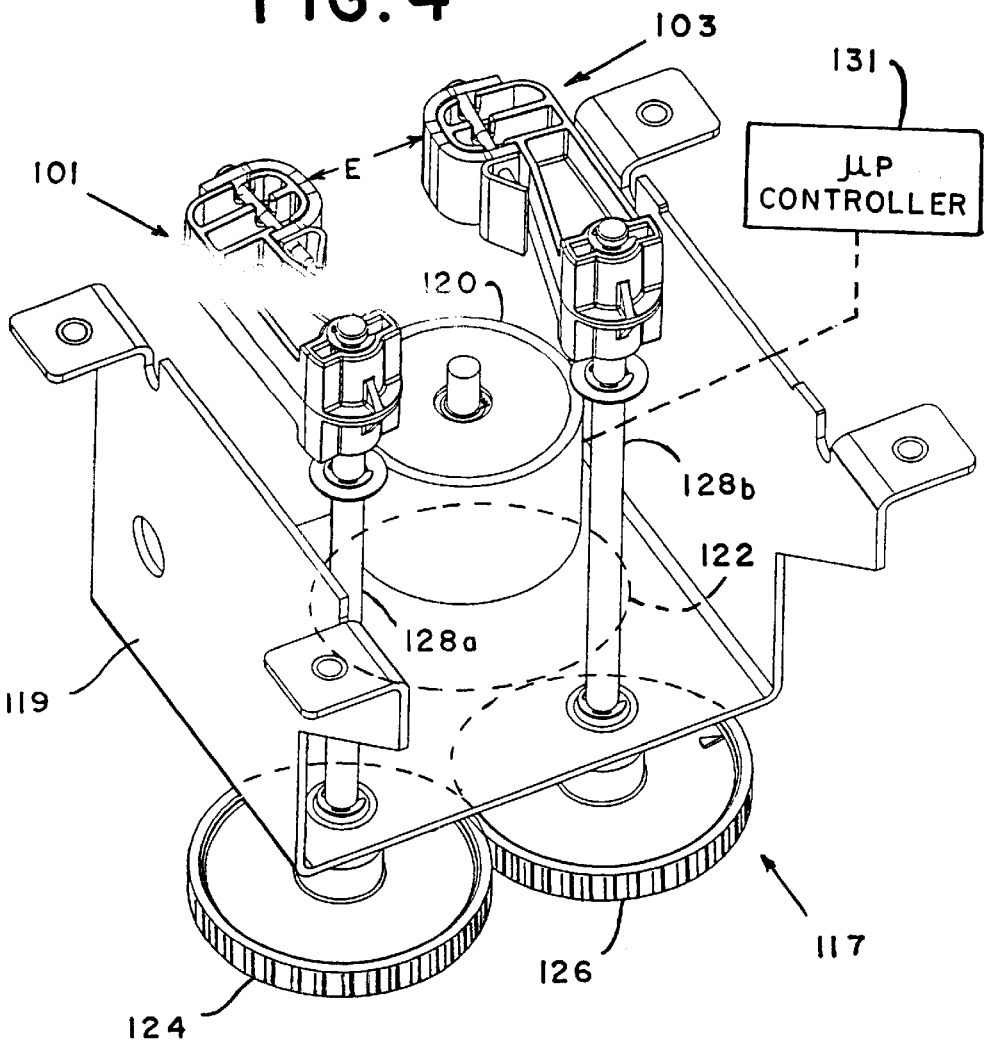
FIG. 4 is a perspective view of the actuating assembly and the trap levers.

FIG. 4 illustrates an actuating assembly 117 for trap levers 101, 103. The trap levers 101, 103 can be actuated by the actuating assembly 117 (which can be mounted under deck 2 using bracket 119) which comprises an electromagnetic solenoid actuator or brushless torque actuator (BTA) 120 attached to a drive gear 122 which drives two driven gears 124, 126. A microprocessor 131 controller may be used to control the actuation of the BTA 120 and other gap control apparatus. The two driven gears 124, 126 are coupled to a drive shafts 128*a*, 128*b* respectively, and each drive shaft

128*a*, 128*b* is coupled to trap lever 101, 103 respectively. The trap levers 101, 103 are mounted such that in the resting position, a gap E (illustrated in FIG. 4) which is slightly wider than the thickest anticipated mailpiece is present between the trap levers 101, 103 to ensure proper actuation time and prevent mailpieces from hitting the trap levers 101, 103 as they travel through the aligner station 31. The gears 122, 124, 126 are designed with high tolerances which provide for less resistance of the driven gear 124, 126 and less friction during operation which causes more efficient operation and reduces noise.

Figure 5:
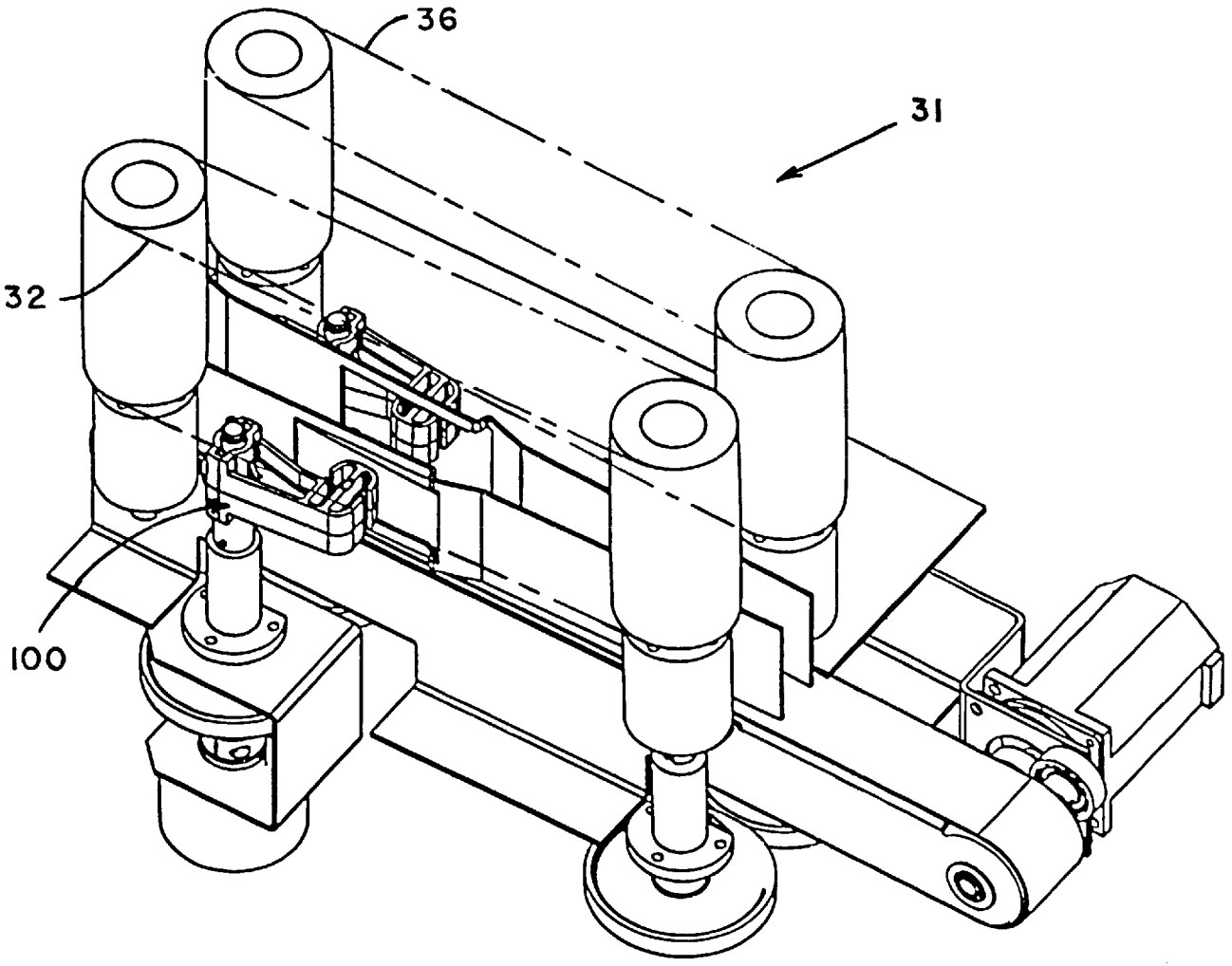
FIG. 5 is a perspective view of an alternate embodiment of the aligner mechanism of the present invention.

In an alternate embodiment (illustrated in FIG. 5), instead of guide walls, two vertically oriented transport belts 32, 36 positioned parallel to and on each side of the aligner station 31 above the trap subassembly 100. The vertically oriented belts are driven in the direction of the feed path and serve to move the mailpieces along the paper path as well as provide support for the mailpieces in a similar fashion to the guide walls 31, 35.

Figure 6:
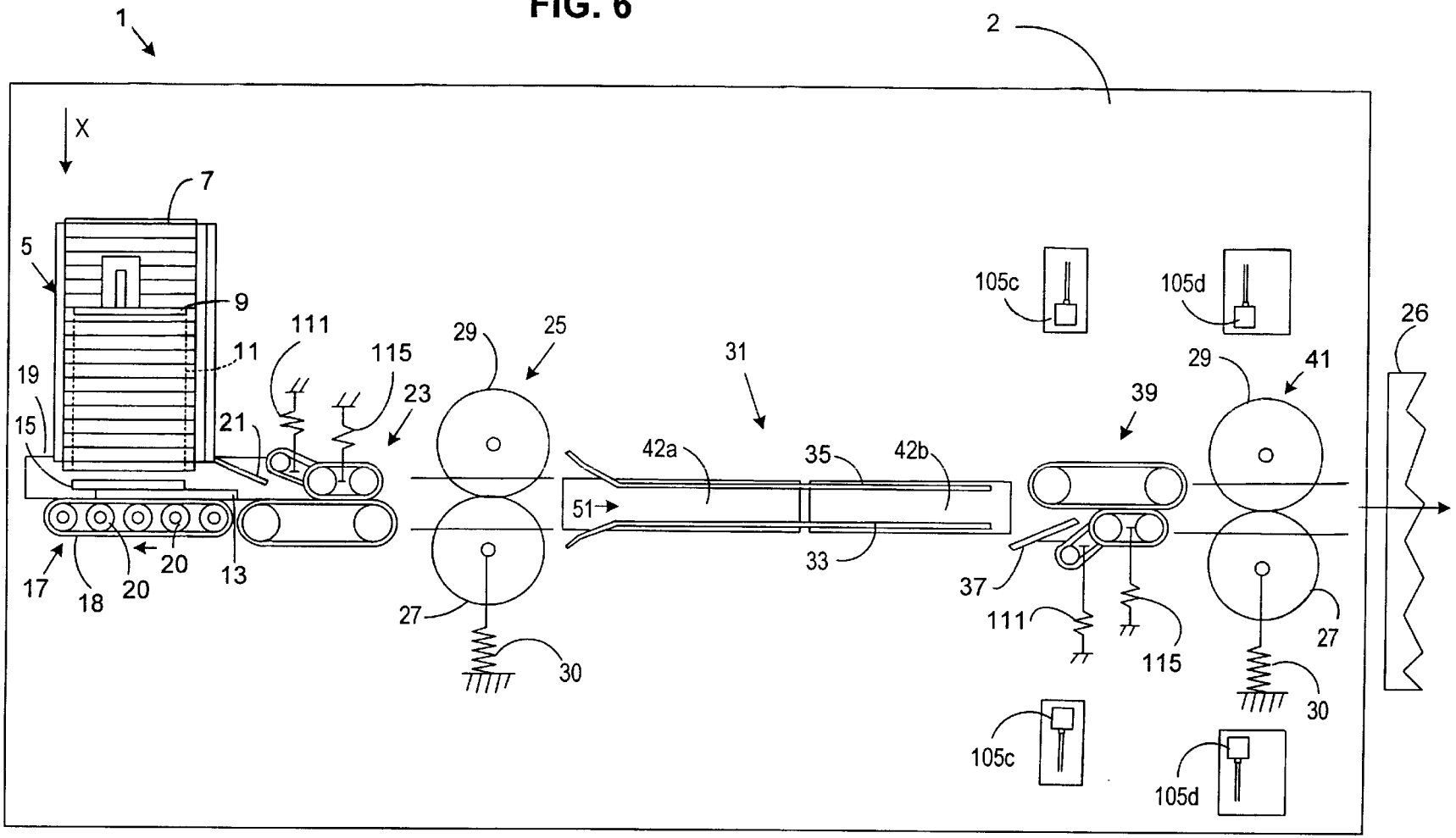
FIG. 6 is a schematic top plan view of an alternate embodiment of the aligner mechanism of the present invention.

In another alternate embodiment (illustrated in FIG. 6), the aligner station 31 comprises guide walls 33, 35 and first and second transport belts 42*a*, 42*b*. The first transport belt 42*a* transports mailpieces from the first set of takeaway rollers 25 into the aligner station 31. The second transport belt 42*b* is positioned downstream from the first transport belt 42*a*, and transports documents out of the aligner assembly. The first transport belt stops the documents while downstream documents are being processed. An example of the first transport belt 42*a* stopping upstream mailpieces follows. When a multiple mailpiece feed is at the second document singulating apparatus 39, a singulator sensor 105*c* is blocked. When a lead mailpiece is singulated and travels downstream to the second set of takeaway rollers 41, the singulator sensor 105*c* remains blocked by other mailpieces in the multipiece feed. The lead mailpiece, positioned at the second set of takeaway rollers 41 blocks the take away sensor 105*d*. When both sensors 105*c*, 105*d* are blocked, the first transport belt 42*a* stops transporting upstream mailpieces and the second transport belt 42*b* continues feeding mailpieces into the second singulating device 39 until the multipiece feed is cleared. After the multipiece feed is cleared, the first transport belt 42*a* resumes the upstream mailpieces.

Figure 7A:
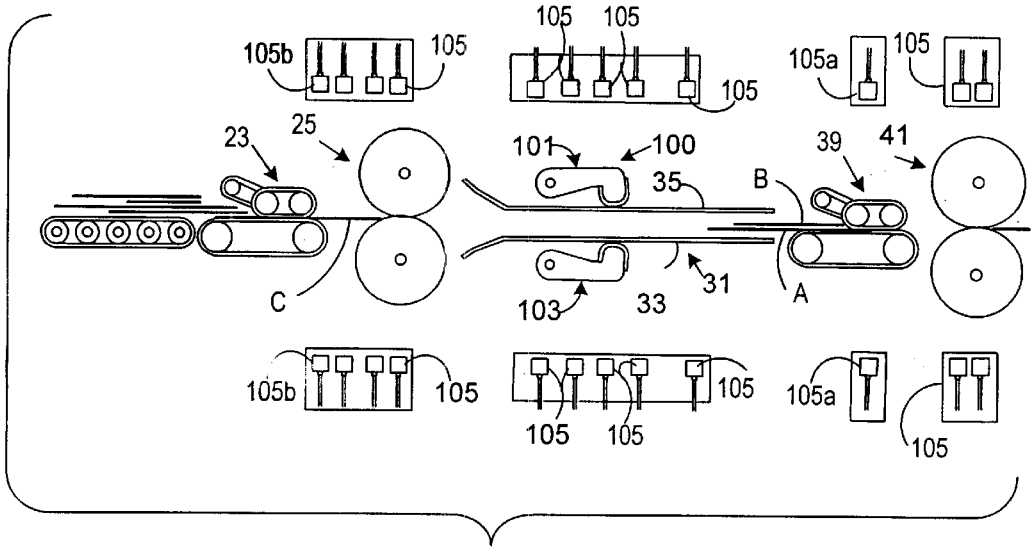
FIGS. 7*a–c* is a simplified schematic top view of an embodiment of the present invention illustrating mailpiece positions in an example of a multiple mailpiece feed at the second document singulating apparatus.
Figure 7B:
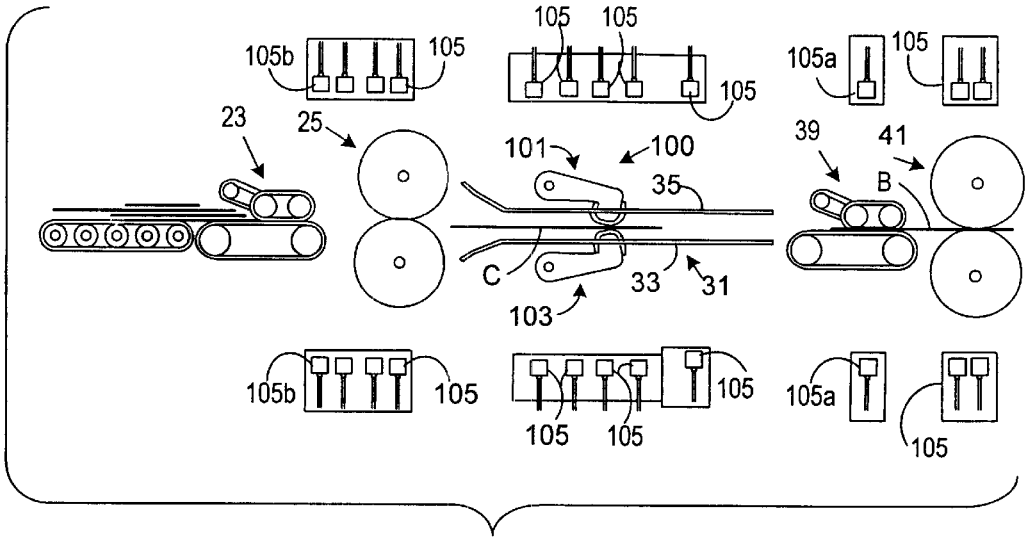
Figure 7C:
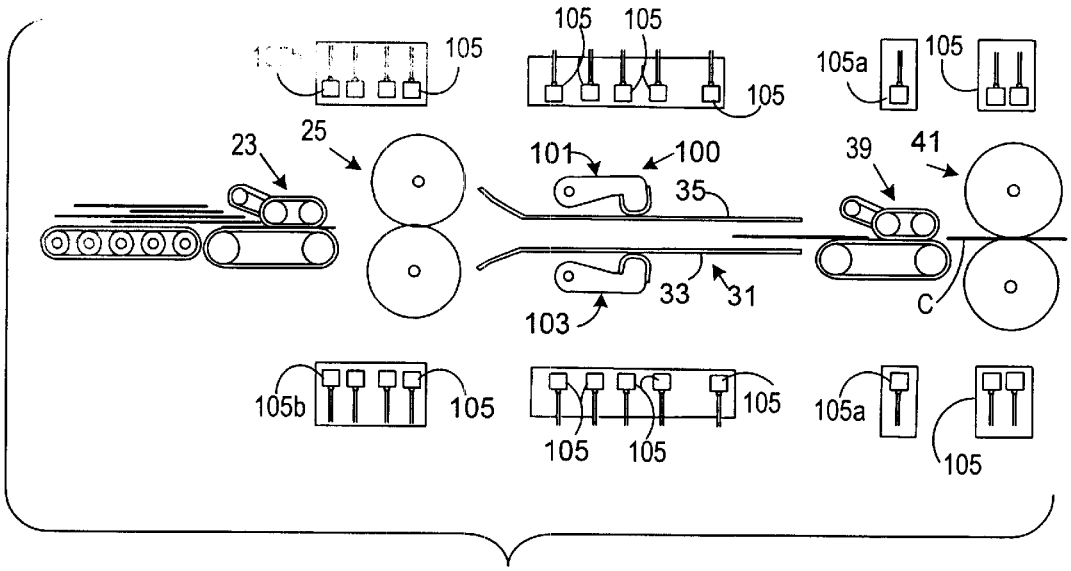

The following is an example of the operation of the aligner station 31 and trap subassembly 100 of the embodiment of FIG. 1, in handling a multiple mailpiece feed at the second document singulating apparatus 39 as illustrated in FIGS. 7*a*–*c*. FIGS. 7*a*–*c* are simplified schematic top views illustrating mailpiece positions at first, second and third successive time increments respectively. In FIG. 7*a*, at the first time increment, two mailpieces, mailpiece A and mailpiece B are fed to the second document singulating apparatus 39, mailpiece A is separated from mailpiece B in the second document singulating apparatus 39. The trail-edge of mailpiece B waits in the aligner station 31. At the second time increment, illustrated in FIG. 7*b* an entry sensor 105*a* for second document singulating apparatus 41 sees the trailing edge of mailpiece B, then mailpiece C is fed into the aligner station 31. The sensors 105 in the area of the aligning station monitor the gap between the trail-edge of mailpiece B and the lead edge of mailpiece C. When the gap between the trail and lead edge of these two mailpieces becomes too small, which is indicated when only one sensor is not blocked (as explained above), and mailpiece C is stopped by the trap subsystem, 100 in the aligner station 31. FIG. 7*c* illustrates the third time increment which shows recovery of normal operation of the mixed mail feeder by singulation of mailpieces A and B and feeding mailpiece C into the second document singulating apparatus 39.

The operation of trapping the mailpieces occurs generally, when only one sensor is not blocked; when this occurs upstream mail flow is stopped. The upstream mail flow can be stopped by take away rollers 25 or the trap subsystem 100 depending upon the position of the upstream mail when too small of a gap is sensed by sensors 105. When the trap subsystem 100 is actuated, all upstream mail flow is stopped. A condition that can cause actuation of the trap subsystem 100 is when a mailpiece is delayed from feeding out of the second document singulating apparatus 39 and another mailpiece is at the trap subsystem and only one sensor is not blocked. A condition that can cause the stopping of mailpiece(s) by the take away rollers 25 is when longer mailpieces are in a multipiece feed situation at the second document singulating apparatus 39 and the trail edge of one or more of those mailpieces is blocking sensors in the aligner station 31 such that only one sensor is not blocked, the take away rollers 25 stop the upstream mailpiece(s).

In the situation where the mailpiece continues to be skewed after passing through the aligner station 31, an over-height sensor 105*a* (shown in FIG. 1) mounted downstream from the aligner station 31 at an overheight position will sense the skewed mailpiece and stop the mail handling machine so that the mailpiece can be manually cleared from the feed path. The over-height sensor 105*a* can also sense mailpieces that are not skewed but are above the maximum height requirements of the mail handling machine.

Finally, the aligner station 31 significantly improves the separation capability of the singulating apparatus 39 by reducing the inter-document forces between the large and small mailpieces via its bottom edge transport and overall configuration such that separation is more easily achieved. The aligner station 31 also improves separation of mailpieces thus helping to prevent mailpieces from colliding and becoming damaged. Additionally, the aligner station 31 provides mailpiece edge alignment while reducing noises such as inter-document noises and mechanically created noises by providing an improved trap lever with an airgap 113 and a trap pad 111 of resilient material and also by providing deceleration of the trap lever 101, 103 prior to final impact with the mailpiece. Noise is also reduced by providing an actuating assembly 117 with high design tolerances such that the gear centers are accurately controlled.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims. For example while the preferred embodiment is described in connection with a mail handling machine, any apparatus for handling mixed or same sizes/thicknesses of articles can utilize the principles of the invention.

What is claimed is:

1. In a device for processing documents being transported therethrough along a document feed path, an aligner apparatus comprising:

a trap assembly comprising first and second trap levers, each trap lever mounted along the document feed, each trap lever opposing the other trap lever and positioned to, when actuated, to cooperatively grab and stop the documents as they move along the feed path in the aligner apparatus so as to control the gap between the documents; and first and second driven vertical belts, each vertical belt positioned on a side of the document feed path and above the trap assembly, forming an alley along the document feed path in which the documents are relieved of interdocument forces and are able to align with the feed path.

2. An apparatus as recited in claim 1 further comprising:

a first singulator, positioned upstream along the document feed path from the driven vertical belts, having a first retard assembly and a first feed assembly disposed opposite to each other along the document feed path, the first retard assembly and the first feed assembly cooperating together on a stack of documents being transported along the document feed path and passing between the first feed assembly and the first retard assembly to separate and transport downstream along the document feed path individual documents from the stack of documents.

3. An apparatus as recited in claim 1 further comprising:

a second singulator, positioned downstream along the document feed path from the driven belts, having a second retard assembly and a second feed assembly disposed opposite to each other along the document feed path, and wherein at times when a plurality of documents from the stack of documents that are in overlapping relationship with each other pass through the first singulator without being separated and are received by the second singulator the second retard assembly and the second feed assembly cooperate together on the plurality of documents to separate and transport individual ones of the plurality of documents downstream along the document feed path.

* * * * *